US006932150B1

(12) United States Patent
Yeh et al.

(10) Patent No.: US 6,932,150 B1
(45) Date of Patent: Aug. 23, 2005

(54) HEAT-DISSIPATION DEVICE

(75) Inventors: Lan-Kai Yeh, Kao Hsiung (TW); Ming-Jye Tsai, Hsin Chu Hsien (TW); Che-Wei Lin, Hsin Chu (TW); Shao-Wen Chen, Feng Yuan (TW); Jin-Cherng Shyu, Ping Tung Hsien (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 10/937,611

(22) Filed: Sep. 10, 2004

(51) Int. Cl.[7] ..... A42B 3/28

(52) U.S. Cl. ..... 165/47; 2/7; 2/171.4; 2/425; 165/185; 165/104.21

(58) Field of Search ..... 165/47, 104.21, 165/185; 2/7, 171.3, 171.4, 425; 607/109

(56) References Cited

U.S. PATENT DOCUMENTS 3,070,803 A * 1/1963 Slepicka ..... 2/7
3,548,415 A * 12/1970 Waters ..... 2/171.3
4,115,874 A * 9/1978 Hasegawa ..... 2/425
4,483,021 A * 11/1984 McCall ..... 2/7
4,484,363 A * 11/1984 Varanese ..... 2/209.13
4,551,857 A * 11/1985 Galvin ..... 2/7
5,561,862 A * 10/1996 Flores, Sr. ..... 2/171.3
6,317,895 B1 11/2001 Erth et al.
6,464,369 B1 10/2002 Vega et al.
6,560,787 B2 5/2003 Mendoza
6,823,531 B1 * 11/2004 Chen ..... 2/171.3
2004/0255364 A1 * 12/2004 Feher ..... 2/171.3

FOREIGN PATENT DOCUMENTS

TW 564683 12/2003
TW 578465 3/2004
TW 579167 3/2004

* cited by examiner

*Primary Examiner*—Allen J. Flanigan
(74) *Attorney, Agent, or Firm*—Rabin & Berdo, P.C.

(57) ABSTRACT

A heat-dissipation device adopted for a safety helmet which includes a heat-transfer unit that functions as a heat pipe, a heat-dissipation unit connecting to the heat-transfer unit, a vent formed in a front of the heat-dissipation unit that can be closed and opened alternatively by a shutter unit in order to adjust the capacity of heat-dissipation thereof, and a covering unit made of insulative materials and spreading over the heat-dissipation unit. Whereby the heat-transfer unit provides a kind of two-phase flow that is capable of conducting heat rapidly, so as to remove heat gathered in the helmet and improve the comfort level for the wearer.

12 Claims, 6 Drawing Sheets

HEAT-DISSIPATION DEVICE

BACKGROUND OF THE INVENTION

1. Field of the Invention

The present invention relates to a heat-dissipation device, and particularly relates to a heat-dissipation device applied inside a safety helmet.

2. Background of the Invention

Wearing safety helmets is the single most effective way to lower the risk of traumatic brain injury and death when someone rides a bike or a motorcycle. As new laws are introduced compelling people to wear helmets, a market for helmets has developed to a certain scope. The strongest reason for enforcing such laws is that sweating is better than bleeding. However, does perspiration really guarantee no blood? Does any helmet simultaneously give consideration to both comfort and safe?

Two characteristics of a conventional helmet are safety and practicability. For safety, a wrapping layer is provided between the head and the outside of the helmet, in order to be prepared for the worst. The wrapping layer usually includes a synthetic resin, Styrofoam or similar polymer materials that absorb the force of an impact that otherwise would result in an injury. But the wrapping layer has low diathermancy per se; heat will accumulate causing discomfort to the wearer. For practical reasons, the helmet should have an ergonomic configuration and snug padding. For further comfort, ventilation outlets are formed in the shell of the helmet.

U.S. Pat. No. 6,464,369 discloses a helmet with a safety light for enhancing a rider's visibility in the dark. U.S. Pat. No. 6,317,895 discloses a buffer device for absorbing shock, so as to protect the user. U.S. Pat. No. 6,560,787 discloses a padding including polyurethane, monoprene gel, polyethylene and either polycarbonate or polypropylene materials, in order to absorb shock and reduce impact. TW Patent No. 579167 discloses a cell phone arranged in a helmet to allow the wearer to communicate while driving. TW Patent No. 578465 discloses a helmet with UV LED for establishing a sterile environment. TW Patent No. 564683 discloses a structure for a helmet which includes supporting members standing in hair, in order to avoid damaging the wearer's hair style. The above patents for helmets fail to resolve the heat problems mentioned earlier.

In another field, data-processing rates increase the generation of heat. Lots of heat sinks with high heat-dissipation efficiencies are provided, such as a heat pipe, a heat exchange channel, a fan, a heat sinking fin, etc. If these heat sinks can be applied to articles for daily use, such as a helmet, we'll all be more comfortable being less hot.

Hence, an improvement over the prior art is required to overcome the disadvantages thereof.

SUMMARY OF INVENTION

The primary objective of the invention is to specify a heat-dissipation device adopted for a helmet. The heat-dissipation device can improve heat-dissipation efficiency by working fluid circulated inside accompanying with the phase change at both evaporation and condensation.

The secondary objective of the invention is to specify a heat-dissipation device adopted for a helmet in which a heat-dissipation device avoids direct sunshine via a shield device.

The third objective of the invention is to specify a heat-dissipation device adopted for a helmet, and the heat-dissipation device has a specific configuration for the transmission of heat to a vent.

The fourth objective of the invention is to specify a heat-dissipation device adopted for a helmet, in which the size of the vent of the heat-dissipation device can be controlled. The fifth objective of the invention is therefore to specify a heat-dissipation device adopted for a helmet, in which the heat-dissipation device is so comfortable that it is widely accepted in the marketplace and its producer's market share is increased thereby, in order to achieve business benefits.

According to the invention, the objectives are achieved by a heat-dissipation device adopted for a helmet. The helmet includes a shell that has an ergonomic inner configuration formed at the upper portion thereof. The heat-dissipation device includes a heat-transfer unit, at least one heat-dissipation unit connecting to the heat-transfer unit, at least one vent formed in a front of the heat-dissipation unit and furthermore a covering unit made of insulative materials. The heat-transfer unit has two-phase flow, the heat-dissipation unit extends outwardly so as to be exposed out of the shell, and the vent can be closed and opened alternatively. Whereby the heat-transfer unit provides a kind of two-phase flow that is capable of conducting heat rapidly, so as to remove heat gathered in the helmet and improve the wearer's comfort level.

To provide a further understanding of the invention, the following detailed description illustrates embodiments and examples of the invention. Examples of the more important features of the invention have thus been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

According to the present invention, a heat-dissipation device adopted for a helmet includes a vent that can be closed alternatively and a heat sink that has been developed in the electronic field, such as a heat pipe or a heat exchanger, thus heat originally gathered inside the helmet can be delivered outwardly by the heat sink and dissipated outside via the vent, in order to increase the comfort of the helmet.

Figure 1:
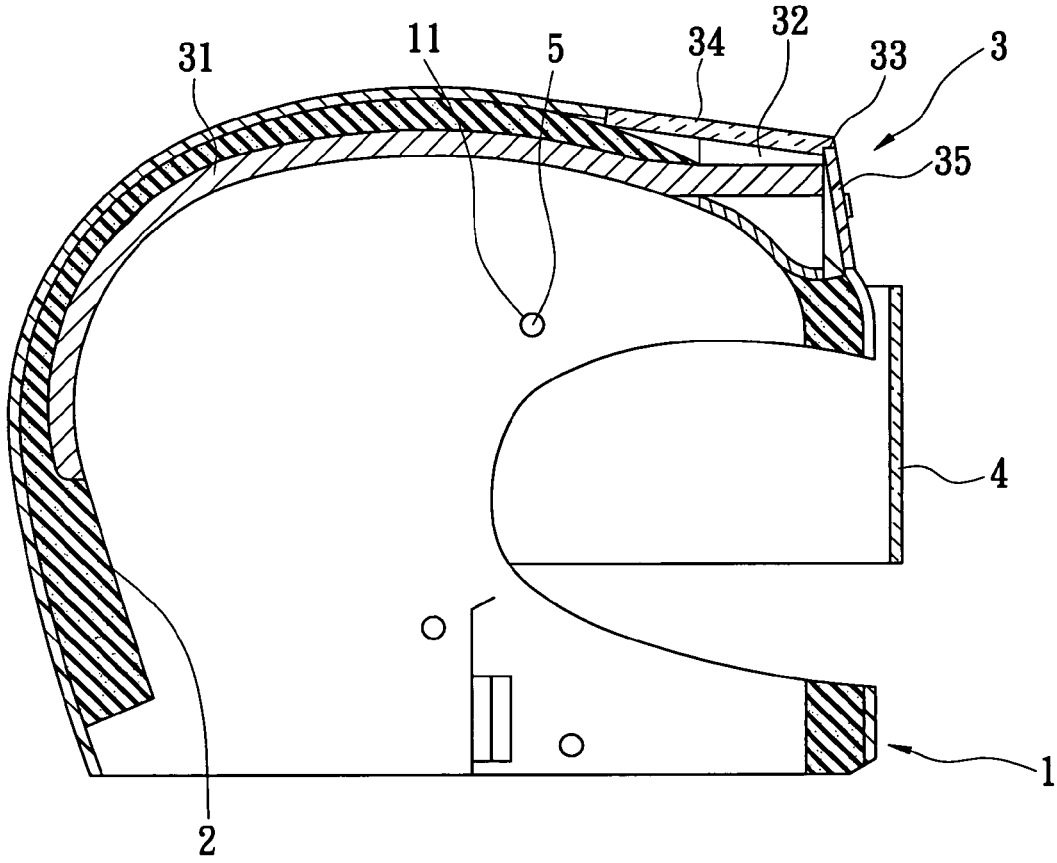
FIG. 1 is a cross-sectional profile of a heat-dissipation device of a first embodiment according to the present invention.

With respect to FIG. 1, a heat-dissipation device 3 adopted for a helmet according to the first embodiment is disclosed. The helmet includes a shell 1 that has an ergonomic inner configuration 2 formed at an upper portion thereof and covering a wearer's head. The heat-dissipation device 3 includes a heat-transfer unit 31, at least one heat-dissipation unit 32 connecting to the heat-transfer unit 31, at least one vent 33 formed in a front of the heat-dissipation unit 32, at least one covering unit 34 spreading over the heat-dissipation unit 32, and a shutter unit 35 arranged in front of the vent 33.

The heat-transfer unit 31 has a specific configuration as the ergonomic inner configuration 2, extends from a rear to a front of the shell 1 for contact with the head exactly for heat transfer. The heat-transfer unit 31 such as a heat pipe, a flat plate heat pipe or a heat exchanger has two-phase flow that is circular to accompany the states of both evaporation and condensation.

As we know, three basic components of the heat pipe are: a sealed container, a wick structure, and a working fluid. After an electronic device or a hot member contacts an evaporator section of the heat pipe, the heat is transferred to an inner wall of the sealed container, the wick structure and the working fluid. Meanwhile, the working fluid absorbs the latent heat into vapor from liquid, in order to enable the heat pipe to operate against gravity and to generate a high capillary driving force owing to the pressure of the evaporation section, the pressure is higher than that of a condenser section. The vapor releases the latent heat into the condenser section after the working fluid passes the wick structure and the inner wall of the sealed container, the latent heat can be transferred outside thereby. After the latent heat is transferred, the working fluid becomes a liquid due to the pressure difference and travels back to the evaporation section to repeat the cycle again. Therefore, the heat-transfer unit 31 is characterized by the heat absorption of the evaporation section and the heat release of the condenser section. The evaporation section can be arranged along the ergonomic inner configuration 2 (shown in FIG. 3), in order to absorb the heat gathered inside the helmet, and the condenser section can be connected with the heat-dissipation unit 32 in order to delivery heat away.

The heat dissipation unit 32 can extends from the heat-transfer unit 31 outwardly to be exposed outside of the shell 1 and contact exterior air via the vent 33. FIG. 1 illustrates the heat-dissipation unit 32 arranged in a front of the heat-transfer unit 31, and the heat-dissipation unit 32 is disposed in a front of the helmet thereby. In addition, the heat-dissipation unit 32 includes a plurality of fins 321 attached to the heat-transfer unit 31 and a plurality of passageways 322 alternately formed with the fins 321, the passageways 322 communicate with the vent 33. The materials of the fins 321 and aspect ratios of the passageways 322 are concerned with the capacity of heat dissipation thereof.

Figure 2:
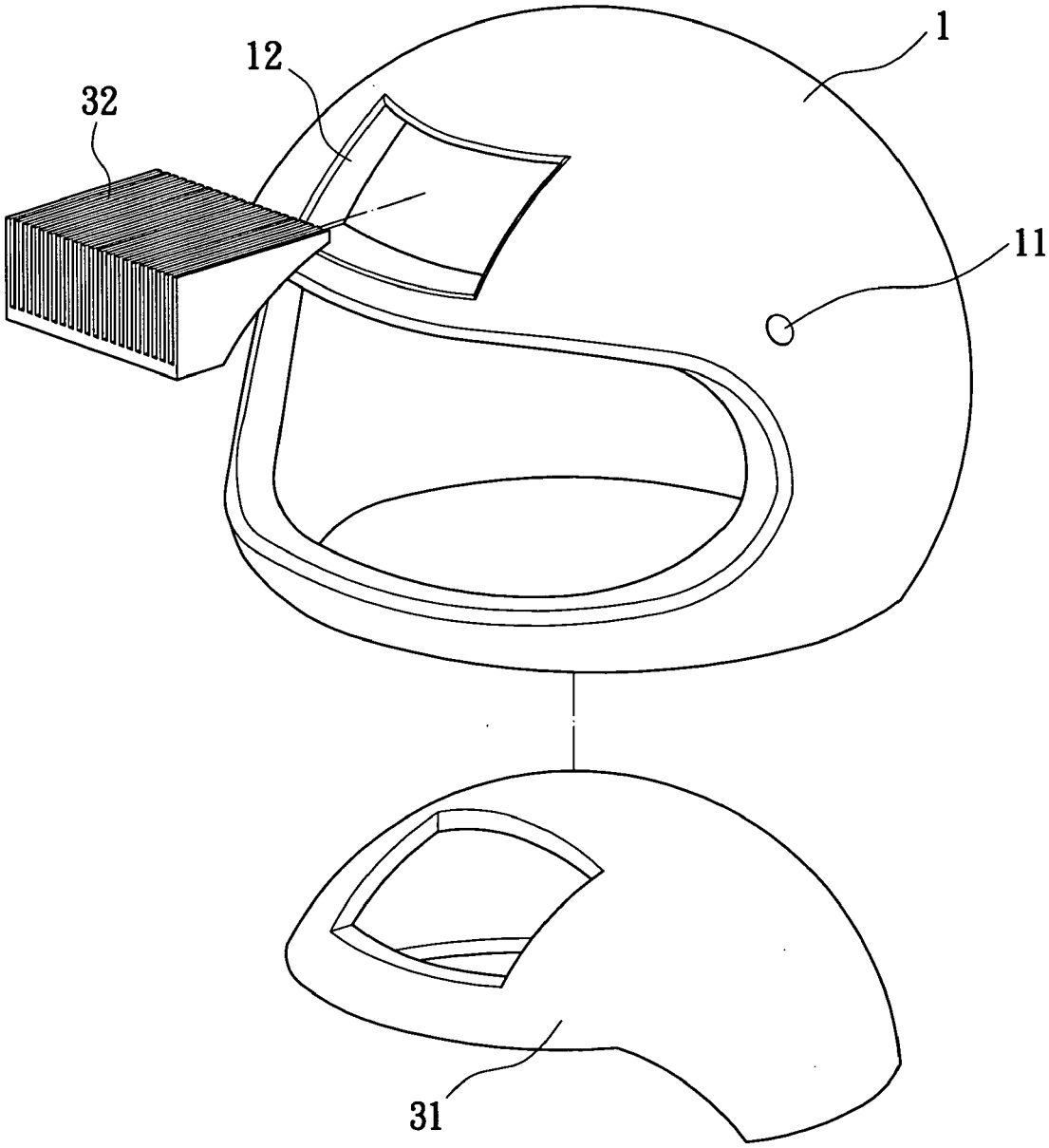
FIG. 2 is an explosion view of the heat-dissipation device according to the present invention.

FIG. 2 shows the heat-dissipation unit 32 that can be assembled to the heat-transfer unit 31. The shell 1 has an opening 12, the heat-dissipation unit 32 penetrates through the opening 12 to connect to the heat-transfer unit 31, so that the heat-transfer unit 31 arranges along the ergonomic inner configuration 2, so that it extends from the rear to the front of the shell 1 and extends from a middle to a lateral side simultaneously covering most of the user's head. The helmet in FIG. 1 further shows a defending cover 4 connected in a secure hole 11 of the shell 1 via a screw 5. FIG. 2 shows the heat-transfer unit 31 secured in the shell 1 by a screw or abutting against the screw 5, so as to be arranged properly in the helmet.

The covering unit 34 is made of insulative materials with low heat conductivity, in order to keep exterior heat outside and to prevent the condenser section from ineffective heat dissipation due to direct sunshine. The covering unit 34 is made of asbestos, glass fibre, or porous materials.

Figure 3:
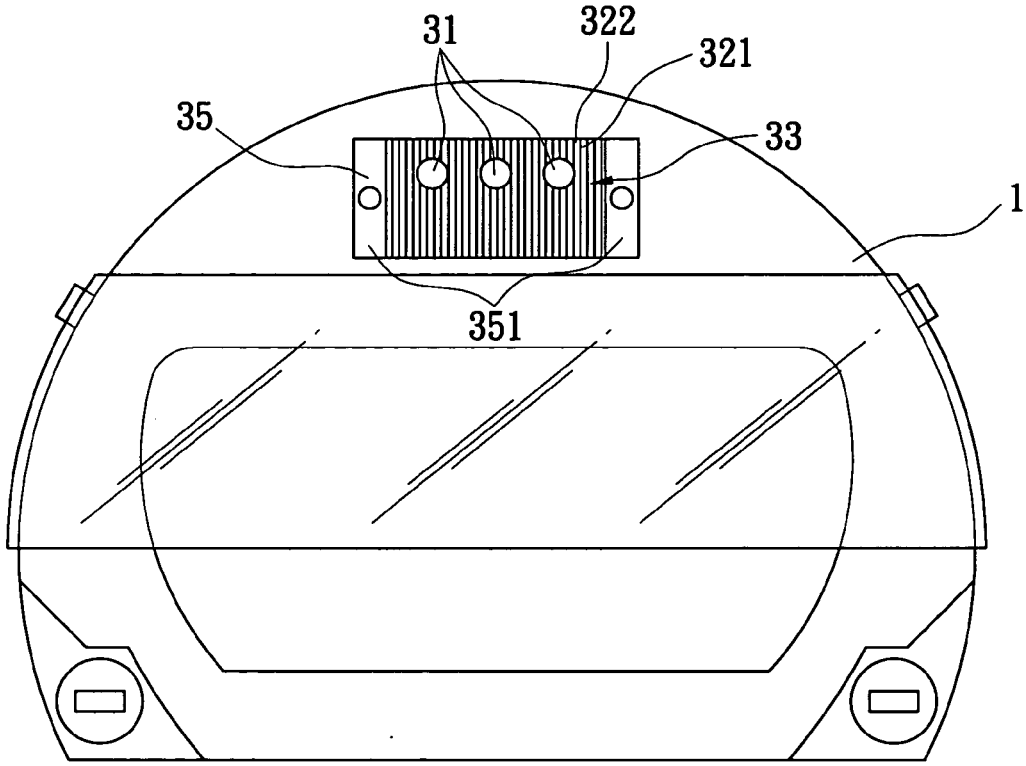
FIG. 3 is a perspective view of the heat-dissipation device of the first embodiment according to the present invention.
Figure 4:
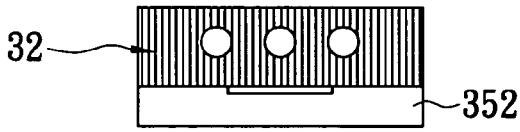
FIG. 4 is a perspective view of the heat-dissipation device of a second embodiment according to the present invention.
Figure 5:
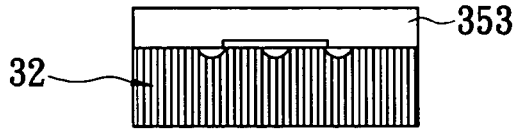
FIG. 5 is a perspective view of the heat-dissipation device of a third embodiment according to the present invention.

FIG. 3 illustrates the shutter unit 35 according to the first embodiment; the shutter unit 35 includes two lateral sliding doors 351, which can be adjusted rightwards or leftwards. If there is no need to dissipate heat, the shutter unit 35 can be closed. While the shutter unit 35 is opened, the heat-dissipation unit 32 can contact the exterior air for heat exchange, as in FIG. 3. With respect to FIGS. 4 and 5, the shutter unit 35 can be a single sliding door in an up-to-down manner, for example, a down-pulled sliding door 352 in FIG. 4 or an up-pushed sliding door 353 in FIG. 5, can both control the size of the vent 33.

Figure 6:
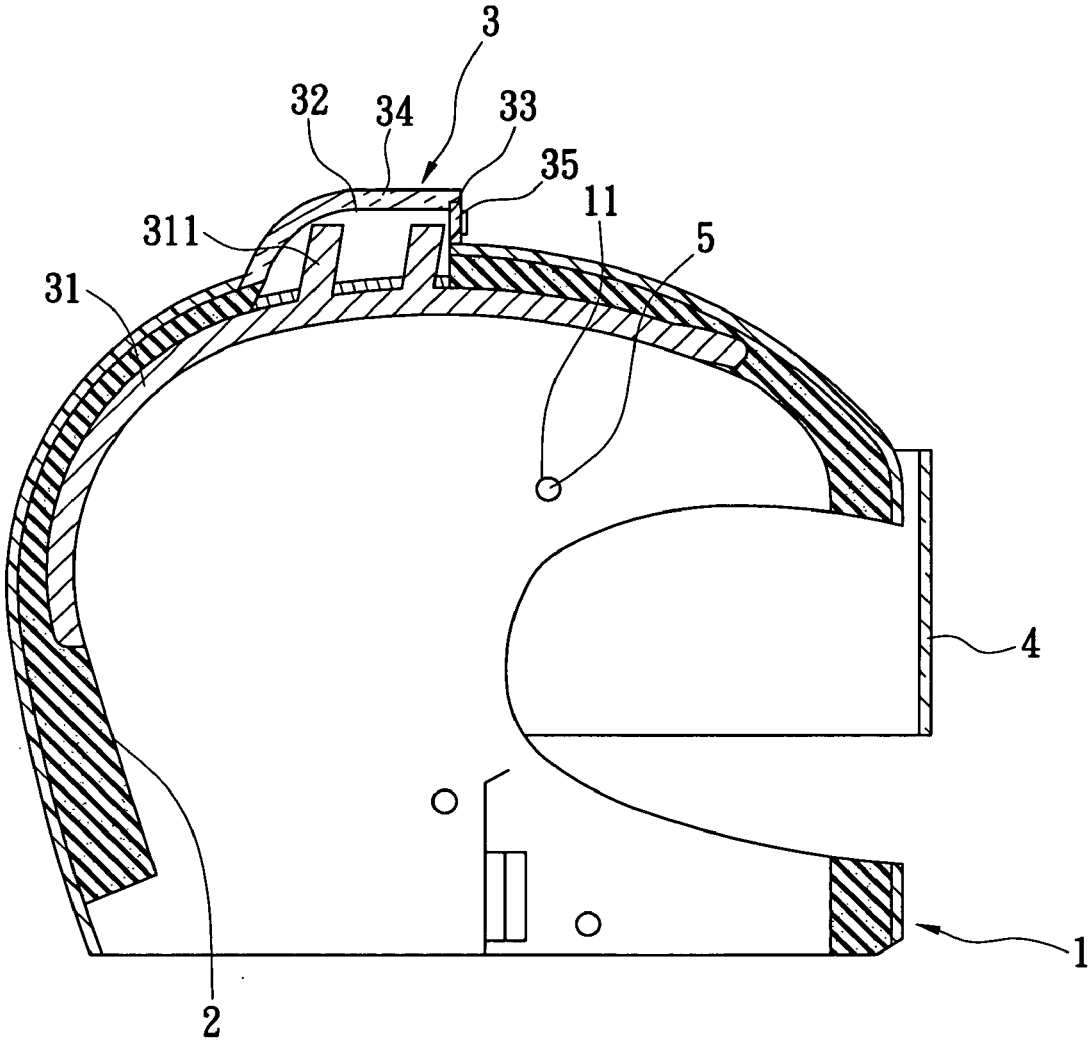
FIG. 6 is a cross-sectional profile of the heat-dissipation device of the third embodiment according to the present invention.

FIG. 6 shows the heat-dissipation unit 32 can be arranged over the heat-transfer unit 31, the heat-transfer unit 31 includes a heat conductive portion 311 upwardly extending in order to contact with the heat-dissipation unit 32. Therefore, the evaporation section and the condenser section can be designed to comply with various positions of the heat-dissipation unit 32.

Figure 7:
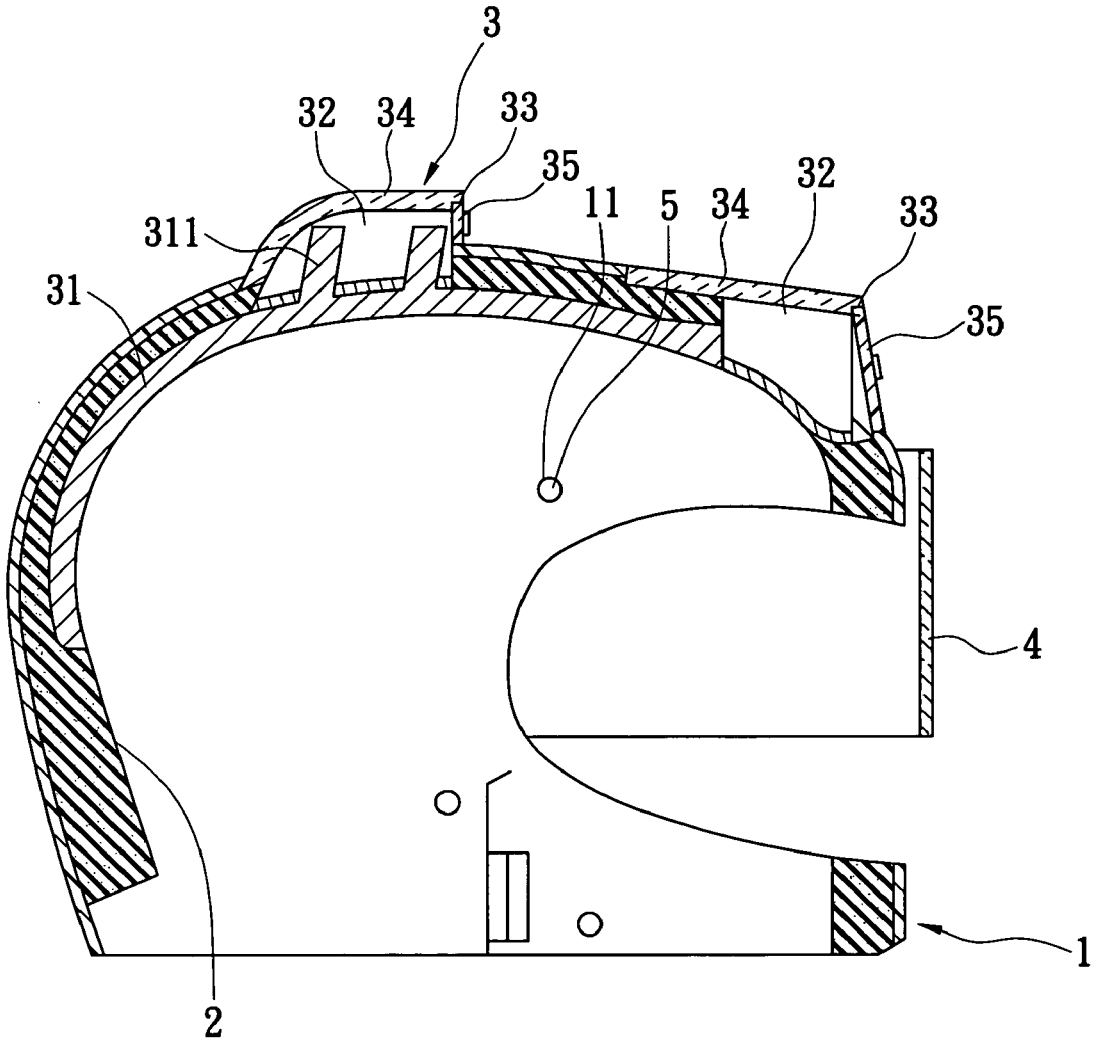
FIG. 7 is a cross-sectional profile of the heat-dissipation device of a fourth embodiment according to the present invention.
Figure 8:
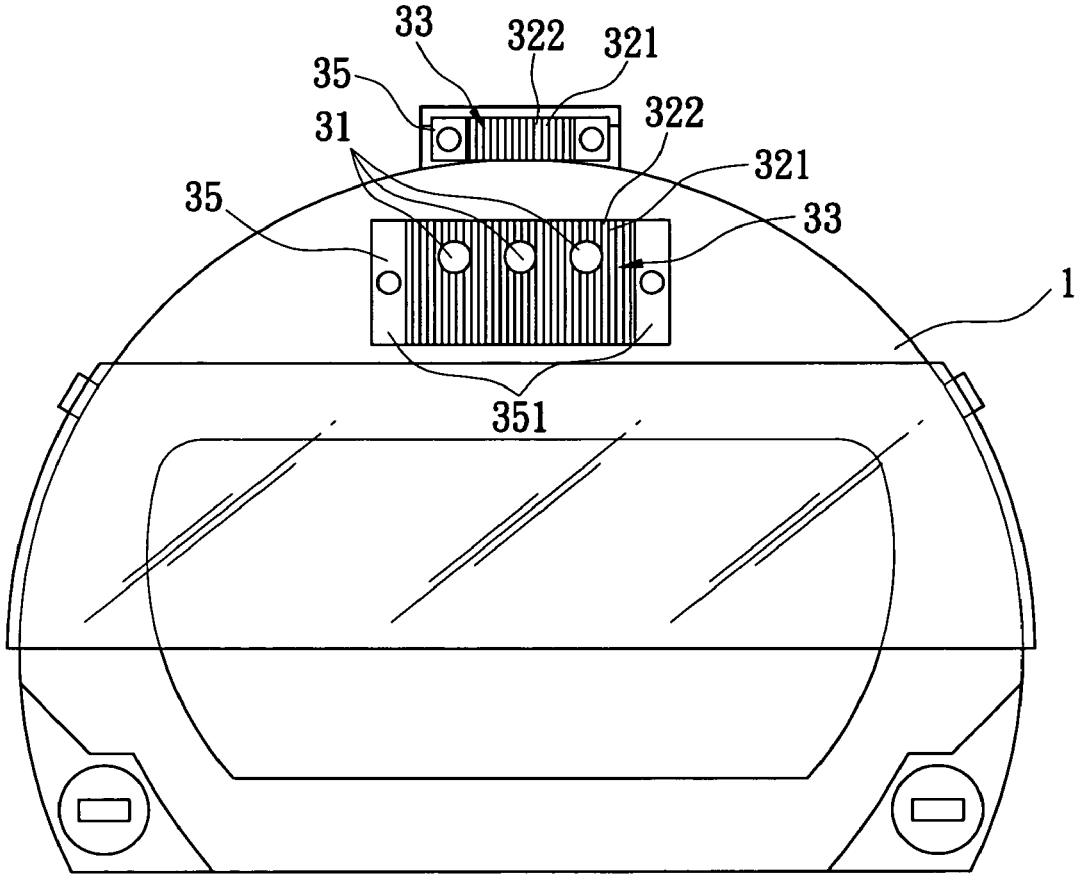
FIG. 8 is a front view of the heat-dissipation device of the fourth embodiment according to the present invention.

Referring FIGS. 7 and 8, the heat-dissipation device 3 includes two heat-dissipation units 32, one is arranged in the front of the heat-transfer unit 31, and the other is arranged over the heat-transfer unit 31, for further increasing heat dissipation efficiency and the comfort of the helmet.

Advantages of the present invention are summarized as follows:

1. To improve the heat-dissipation efficiency by the working fluid with the phase change at both evaporation and condensation.
2. To avoid direct sunshine and to keep exterior heat away by the shield device.
3. To transfer heat rapidly by the specific arrangement of the heat-transfer unit with the ergonomic inner configuration.
4. To control the size of the vent to allow it to be worn comfortably in various climates and temperatures.
5. To take into consideration both safety and comfort, in order to raise market acceptance and market share for the producer, and further the commercial benefits.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A heat-dissipation device adopted for a helmet including a shell, wherein the shell has an ergonomic inner configuration formed at an upper portion thereof, and the heat-dissipation device comprising:

a heat-transfer unit being the ergonomic inner configuration and having two-phase flow;

at least one heat-dissipation unit connecting to the heat-transfer unit, and extending outwardly so as to be exposed outside of the shell; and at least one vent formed in a front of the heat-dissipation unit, and being able to be closed and opened alternatively.

2. The heat-dissipation device as claimed in claim 1, further including a covering unit spreading over the heat-dissipation unit.

3. The heat-dissipation device as claimed in claim 1, further including at least one shutter unit arranged in front of the vent and controlling the capacity of heat-dissipation thereof.

4. The heat-dissipation device as claimed in claim 1, wherein the heat-transfer unit extends from a rear to a front of the shell.

5. The heat-dissipation device as claimed in claim 1, wherein the heat-transfer unit is a heat pipe, a flat plate heat pipe or a heat exchanger.

6. The heat-dissipation device as claimed in claim 1, wherein the heat-dissipation unit includes a plurality of fins attached to the heat-transfer unit and a plurality of passageways alternately formed with the fins, the passageways communicate with the vent.

7. The heat-dissipation device as claimed in claim 2, wherein the covering unit is made of insulative materials with low heat conductivity.

8. The heat-dissipation device as claimed in claim 7, wherein the covering unit is asbestos, glass fibre, or porous materials.

9. The heat-dissipation device as claimed in claim 3, wherein the shutter unit includes two lateral sliding doors.

10. The heat-dissipation device as claimed in claim 3, wherein the shutter unit includes a single sliding door in an up-to-down manner.

11. The heat-dissipation device as claimed in claim 1, wherein the heat-dissipation unit is arranged in a front of the heat-transfer unit.

12. The heat-dissipation device as claimed in claim 1, wherein the heat-dissipation unit is arranged over the heat-transfer unit, and the heat-transfer unit includes a heat conductive portion upwardly extending in order to contact with the heat-dissipation unit.

* * * * *